US010595645B2

(12) United States Patent
Garcia et al.

(10) Patent No.: US 10,595,645 B2
(45) Date of Patent: Mar. 24, 2020

(54) SAND-FILLED MATTRESS

(71) Applicants: Michael Alan Garcia, Glendale, CA (US); Stephanie Jan Wing-Garcia, Glendale, CA (US)

(72) Inventors: Michael Alan Garcia, Glendale, CA (US); Stephanie Jan Wing-Garcia, Glendale, CA (US)

( * ) Notice: Subject to any disclaimer, the term of this patent is extended or adjusted under 35 U.S.C. 154(b) by 0 days.

(21) Appl. No.: 15/421,120

(22) Filed: Jan. 31, 2017

(65) Prior Publication Data

US 2018/0235375 A1 Aug. 23, 2018

Related U.S. Application Data

(60) Provisional application No. 62/289,348, filed on Feb. 1, 2016.

(51) Int. Cl.
*A47C 27/00* (2006.01)
*A47C 27/08* (2006.01)

(52) U.S. Cl.
CPC ..... *A47C 27/086* (2013.01); *A47C 27/00* (2013.01); *A47C 27/002* (2013.01)

(58) Field of Classification Search
CPC ..... A47C 27/00
USPC ..... 5/419–421, 740
See application file for complete search history.

(56) References Cited

U.S. PATENT DOCUMENTS

| | | | |
|---|---|---|---|
| 3,521,311 | A | 7/1970 | Cohen |
| 4,279,045 | A | 7/1981 | Vitale |
| 4,809,375 | A | 3/1989 | Bull |
| 2001/0054200 | A1 | 12/2001 | Romano |
| 2003/0000014 | A1 | 1/2003 | Sopher et al. |
| 2013/0263377 | A1 | 10/2013 | Wootten, Jr. |
| 2015/0053317 | A1 | 2/2015 | Fan |

FOREIGN PATENT DOCUMENTS

WO PCT/US17/15854 1/2017

OTHER PUBLICATIONS

U.S. Appl. No. 62/289,348, dated Feb. 1, 2016, Garcia.
International Search Report and Written Opinion issued for corresponding PCT/US17/15854, dated May 25, 2017.

*Primary Examiner* — Fredrick C Conley
(74) *Attorney, Agent, or Firm* — Wilson, Elser, Moskowitz, Edelman & Dicker LLP

(57) ABSTRACT

The invention provides an improved mattress for sleeping which is to be filled with sand to recreate a sleep experience predating the invention of the modern spring-type, or bladder-type mattress (i.e. air or water-filled). For example, by filling the mattress with sand, it recreates the essence of sleeping on the earth itself. The mattress is composed of a hollow, fillable shell, the bottom and sides of which are constructed from a single piece of heavy duty, durable synthetic fabric; the top panel (or sleeping surface) is constructed from natural fiber fabric.

20 Claims, 7 Drawing Sheets

SAND-FILLED MATTRESS

CROSS-REFERENCE TO RELATED PATENT APPLICATIONS

This application claims priority to U.S. Provisional Patent Application Ser. No. 62/289,348, filed Feb. 1, 2016.

BACKGROUND OF THE INVENTION

1. Field of Invention

This invention relates generally to a mattress and more specifically, to an improved mattress and method for creating a natural sleep experience.

2. Description of Related Art

In the modern era, most of the Western world has adopted the practice of sleeping on a type of mattress called the innerspring mattress. Today's innerspring mattress had its humble beginnings as a simple coil spring technology first patented in 1865. Eventually, the innerspring mattress would be widely combined with a box spring to provide further support in the form of a firm platform usually constructed from an upholstered structure of wood and wire. Pocketed springs, or springs separately encased in a fabric or textile material, were introduced to the world in 1900 by inventor James Marshall. In the decades that followed, various other forms of mattresses were invented including mechanically adjustable mattresses, foam rubber-filled mattresses (i.e. visco-elastic, polyurethane, or latex foam, etc.), water-filled mattresses, and air-filled mattresses.

These modern mattress designs have enjoyed tremendous commercial success, yet they still do not satisfy the needs of all sleepers. The desire for soft bedding has led humankind toward these types of modern mattresses and further away from the natural sleep experience that our ancestors enjoyed for many millennia prior to the invention of the innerspring mattress.

The modern innerspring mattress has been identified, by some, as the cause of chronic back pain, shoulder pain, neck pain, poor sleep, and insomnia. Modern mattresses are unnatural and our bodies are unfit to sleep on such devices. To address the myriad of symptoms related to sleep on modern mattresses, many seek alternatives such as sleeping on solid or very firm surfaces.

The issues related to the modern mattress, however, are not limited to chronic pain. The inability for most mattresses to be cleaned also leads to hygienic issues that are difficult to remedy. As an example, these hygienic issues include mite and bedbug infestations, accumulation of dust and dead skin, and staining from sweat, incontinence or the like that may contribute to bad odors emanating from the mattress. Unfortunately, the past century and a half has provided no suitable alternative to recreate the manner in which our ancestors slept while simultaneously allowing for the comfort of sleeping indoors.

If history has proven anything, it is that humanity can survive and has spent most of its existence sleeping on the ground, whether on a bed of leaves, animal skins or bare earth. And the benefits of a natural sleep experience are now revealed after decades of mixed experiences (positive, negative or otherwise) sleeping on synthetic, engineered mattresses. Referred to as "grounding," new avenues of research have demonstrated an energetic exchange exists between the body and the earth that can be beneficial and healing to the body's functions.

The sand-filled mattress of the present invention solves these issues by providing a simple and effective way to sleep on a quantity of natural earth indoors while maintaining the look and feel of a traditional mattress. Issues of cleanliness that would arise from bringing a large amount of earthen material indoors are eliminated by the advantageous design of the sand-filled mattress. The construction of the present invention contains the high-grade sand filler within and eliminates leakage. A higher degree of firmness than a traditional mattress is achieved through the present invention's ability to be filled completely with a dense material such as sand. Hygienic issues that arise with the inability to effectively clean traditional mattresses are eliminated with the sand-filled mattress because it can be emptied, cleaned and re-filled at will.

SUMMARY OF THE INVENTION

Disclosed herein is a mattress for creating a natural sleep experience. The present disclosure is equally applicable, in general, to cushions and pads of various shapes and sizes. The mattress of the present invention is constructed to form a fabric shell including an upper section and a lower section. Each section is comprised of a single piece of fabric and joined along the perimeter of each said section. To create the mattress, the fabric shell is filled with non-toxic, earthen filler material, preferably crushed white marble sand. The single piece of fabric of the lower section is larger than the single piece of fabric of the upper section and by virtue of the excess fabric and a vertical corner assembly as described herein at FIG. 2, four vertical side walls of the mattress are created. To facilitate the importation of the non-toxic earthen material, a zippered aperture is located along a portion of the length of one of the four vertical side walls.

The present disclosure also contemplates a method for the construction of the mattress. The mattress comprises a fabric shell created from two pieces of fabric forming an upper section and a lower section. Four vertical side walls of the mattress are created by virtue of four vertical corner assemblies from the single piece of fabric of the lower section by gathering a corner of the fabric of the lower section, folding this corner inward to create a fabric triangle, valley folding this inner triangle to bisect its 90 degree apex, and stitching along both legs and hypotenuse of the resulting vertical fabric triangle with heavy duty, upholstery thread. The upper section is joined to the lower section including the four vertical side walls by double stitched seams along the perimeter of the upper section and the perimeter of the lower section forming the open edge of the four vertical side walls. A zippered aperture is created along a portion of the length of one of the four vertical side walls and a cover provided for the zippered aperture by stitching a fabric flap along its upper edge above the zippered aperture and removably affixing by hook and loop fasteners along the bottom, right, and left edges of the fabric flap. The mattress is filled via the zippered aperture with non-toxic, crushed white marble sand.

The mattress of the present invention provides a higher degree of firmness eliminating for some the chronic pain often associated with the softer counterparts of modern mattresses. In addition, the mattress of the present invention eliminates hygienic issues typically associated with the inability and difficulties related to the cleaning of many modern mattresses.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
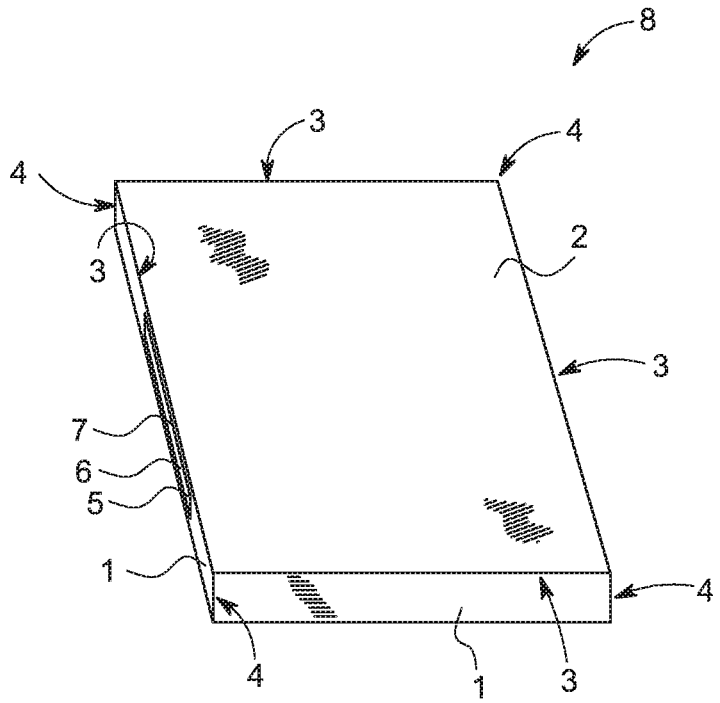
FIG. 1 illustrates a perspective view of the mattress according to an embodiment of the invention.

Preferred embodiments of the present invention and their advantages may be understood by referring to FIGS. 1-7, wherein like reference numerals refer to like elements. Although the present invention is described and illustrated in the context of a mattress, it is to be understood that the disclosure of the present invention is not limited to this embodiment but is equally applicable, in general, to cushions and pads of various shapes and sizes. Accordingly, the discussion in the disclosure below will be limited to the mattress embodiment but it is to be understood that the disclosure relates equally to alternative embodiments such as cushions and pads.

The mattress of the present invention is configured to create a cavity within which the high-grade sand is inserted. As a non-limiting example, the sand is non-toxic, crushed white marble sand. The present disclosure also contemplates a method for the construction of the mattress.

In an embodiment of the invention as illustrated in FIG. 1, the sand-filled mattress 8 is comprised of two pieces of fabric (not shown). The two pieces of fabric come together to form the mattress 8 of the present invention. The mattress 8 includes a lower section 1 and an upper section 2. Upper section 2 is a single piece of natural fiber fabric smaller than the piece of fabric of lower section 1. Lower section 1 and upper section 2 are sewn together with double-stitched seams 3 around the full perimeter of upper section 2. By sewing together the perimeters of lower section 1 and upper section 2, four vertical side walls of the mattress are created. The flat bottom and vertical side walls of lower section 1 are created by virtue of the fabric of lower section 1 being larger than the fabric of upper section 2 and by vertical corner assembly 4.

In a preferred embodiment, the height of the vertical side walls is 3 inches. The 3 inch height of the vertical side wall dictates the number of 50 pound bags of sand needed to fill the mattress. For example, the height was based on a volumetric calculation that allowed for the cavity to be filled with seven (for cot size) or nine (for twin size) 501*b* bags of sand leaving no partial bags of sand leftover. As such, the cot size and twin size mattress maximize the amount earthen filler required to fill the cavity. Alternatively, the present invention contemplates a range of heights for the vertical side walls and is not limited to 3 inches. Rather, the present invention may have vertical side walls between 1 inch and 8 inches; or 2 inches and 6 inches; or 3 inches and 5 inches. The particular height of the vertical side wall will be determined by the end use of the product, i.e., cushion, mattress, or pad, and/or the actual shape and size of the end product. For example, a custom designed shape may require a vertical side wall of x inches high so as to accommodate an exact number of bags of sand.

One longitudinal side of the vertical side walls includes a zippered opening 5 along a portion of its length. The zippered opening 5 is of sufficient length to allow an entire 501*b* bag of sand to fit through the aperture in the mattress vertical side wall. The length of the zippered opening 5 may also be determined by the size of the bag of sand and/or the size of a device implemented to fill the mattress cavity. Thus, a smaller bag of sand, i.e., 25 pounds, would not require the same size zippered opening 5 as the 50 pound bag of sand. In the non-limiting embodiment as illustrated in FIG. 1, the zippered opening 5 centered along the length of one of the longitudinal vertical side walls of mattress 8. However, the precise location of the zippered opening 5 can be located anywhere along the periphery of upper section 2, lower section 1, and/or the vertical side walls of mattress 8. The zippered opening 5 allows for the importation of the mattress filling material to the interior of the mattress and is covered by a fabric flap 6 that may be made from the same heavy duty, synthetic fabric as lower section 1. Fabric flap 6 is connected to the vertical side wall by stitching along the upper edge of fabric flap 6 and by hook and loop fastener 7 along the left, right and bottom inside edges of fabric flap 6. In an alternative embodiment to the hook and loop fastener, fabric flap 6 may be held closed by snap fasteners, buttons, or magnets.

Upper section 2 is the sleeping surface of the mattress and its perimeter is affixed to the perimeter of lower section 1 by double-stitched seams 3. Advantageously, upper section 2 is made of natural fiber so as to conduct the beneficial health, healing, and energetic properties particular to the earthen substance with which the mattress is filled. Upper section 2 forms a flat top piece that completes the flat bottom and vertical side walls of lower section 1, creating the rectangular prism shape of the mattress.

Figure 2:
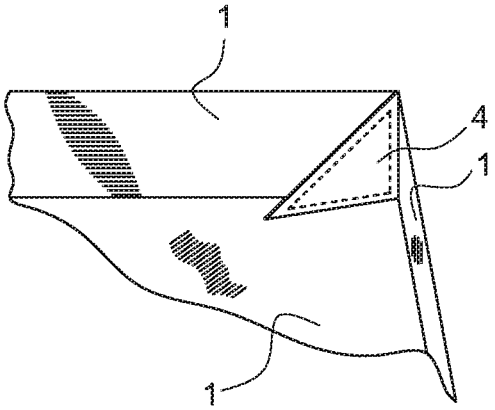
FIG. 2 illustrates a detail view of a corner assembly, showing how the bottom and sidewalls of the lower section are constructed into a corner from a single piece of fabric.

Referring now to FIG. 2, in a preferred embodiment, lower section 1 is a single piece of heavy duty, synthetic fabric larger than the fabric of upper section 2 (not shown). As non-limiting examples, the fabric of lower section 1 may be Cordura® nylon, ballistic nylon, or Kevlar® fabric, hemp, denim, heavy cotton canvas, or leather. Vertical corner assembly 4 is created by gathering a corner of the fabric of lower section 1, folding this corner inward to create a fabric triangle, then valley folding this inner triangle to bisect its 90 degree apex. The resulting vertical fabric triangle is then stitched along both legs and its hypotenuse with heavy duty, upholstery thread.

Figure 3:
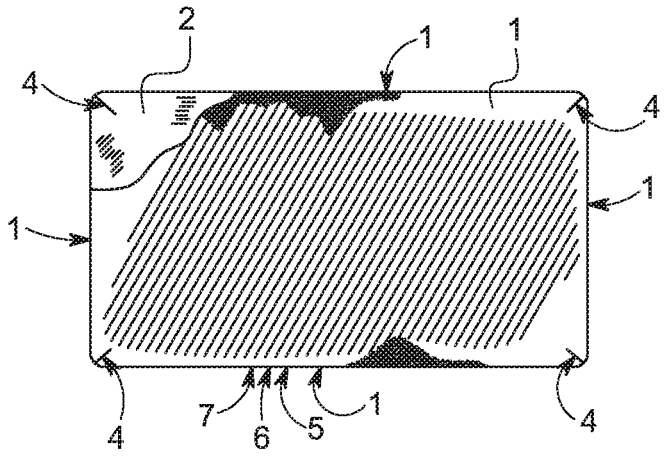
FIG. 3 illustrates a top view into the interior of the lower section and four side walls, with the upper sleep surface portrayed in cut-away for clarity according to an embodiment of the invention.

Referring now to FIG. 3, a top view into the interior of the lower section 1 and four vertical side walls is illustrated with the upper section 2 portrayed in a cut-away for clarity. Advantageously, the creation of the bottom and four vertical sidewalls of the mattress from a single piece of material improves the overall strength and tear resistance of the bottom section, reducing the potential for spillage of the internal material. FIG. 3 illustrates the vertical corner assembly 4 in relation to the four vertical side walls of the rectangular prism shape of the mattress thereby creating the cavity within which the earthen filler material is added via zippered opening 5.

Figure 4:
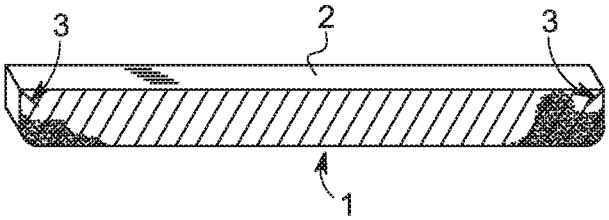
FIG. 4 illustrates a longitudinal cross-sectional view of the mattress, showing upper and lower sections and seams according to an embodiment of the invention.
Figure 5:
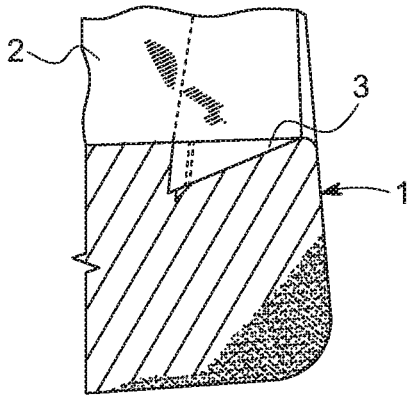
FIG. 5 illustrates detail of an interior double-stitched seam construction, joining lower section to upper sleep surface.

Referring now to FIGS. 4 and 5, FIG. 4 illustrates a longitudinal cross-sectional view of the mattress, showing upper section 2, lower section 1, and double-stitched seams 3 joining upper section 2 and lower section 1. In a preferred embodiment, the fabric of upper section 2 is made of natural fiber. As non-limiting examples, the fabric of upper section 2 may be cotton canvas, hemp, denim, leather, wool, or the like. The double stitched seams 3 are preferably heavy duty, upholstery thread but may be any type of upholstery thread appropriate for the end use of the present invention. For example, depending on the end-use of the present invention, the heavy duty, upholstery thread may be 2-ply or 3-ply bonded nylon, bonded polyester, cotton-wrapped polyester, Kevlar®, and the like. The range of sizes of the upholstery thread may be between #42 to #92 as dictated by the end-use product and know to those of ordinary skill in the art. With respect specifically to FIG. 5, an enhanced close-up view of the double-stitched seam 3 is shown. The double-stitched seam 3 traverses the perimeter of upper section 2. The double-stitched seam 3 is stitched once at the ends of the fabric of upper section 2 and lower section 1 and again to form the edge of the sleeping surface of the mattress at the juncture of upper section 2 and the four vertical side walls.

Figure 6:
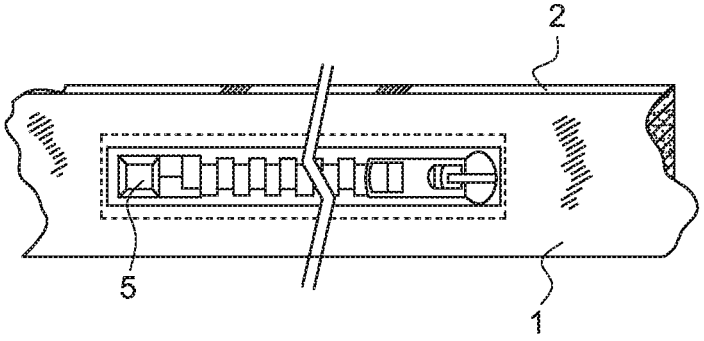
FIG. 6 illustrates detail of the zipper assembly on one sidewall of the lower section with zipper flap omitted for clarity.
Figure 7:
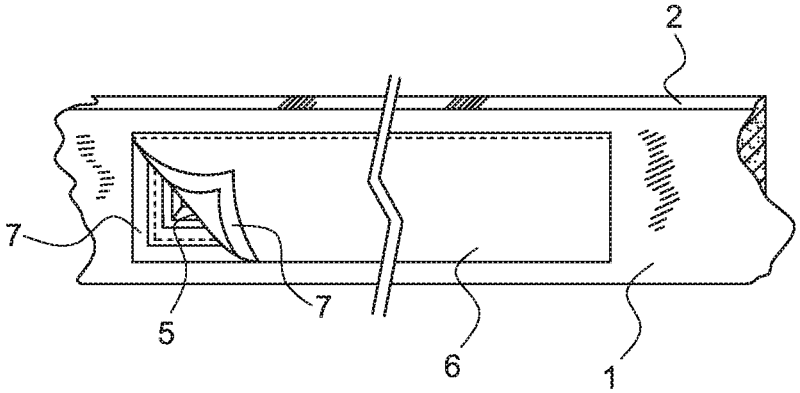
FIG. 7 illustrates detail of a retractable zipper cover flap, with a hook and loop fastener along the sides and bottom of the cover flap.

Referring now to FIGS. 6 and 7 are illustrated the zippered opening 5 and fabric flap 6 located on one of the four vertical side walls of the present invention. In a preferred embodiment, zippered opening 5 is located along the length of one of the longitudinal sides of the four vertical side walls. The zipper of zippered opening 5 may be metal, plastic, or the like but of sufficient strength to avoid leakage of the earthen filler material. Alternatively, the opening of zippered opening 5 may be closed by any suitable means known to one of ordinary skill in the art that is capable of maintaining the integrity of mattress 8 so as to prevent leakage of the earthen filler material. For example, the opening of zippered opening 5 may be closed by way of Velcro® hook and loop fasteners.

One intended use of the present invention is as an indoor mattress filled with high-grade sand. The invention, thusly filled, would then be used instead of a traditional inner spring mattress and box spring upon which to sleep. Traditional bedding (i.e. sheets, pillows, blankets, etc) may be fitted on top of the sand-filled mattress if so required. Additional layers may be added to the bed such as covering it with a natural latex foam topper; natural sheepskin pelt; a wool pad; or cotton, feather, buckwheat hull or hemp padding; silk wadding; grounding pads utilizing silver metal threads woven into fabric; acupressure mats; amethyst crystal pads; and/or magnetic pads. It is contemplated by the present invention that the materials used to construct the invention are completely natural fabrics with no synthetics, certified organic fabrics, stronger and more durable fabrics, and the like. It is to be understood by those of ordinary skill in the art that the present invention, however, may be constructed of any suitable material to achieve the embodiments described herein. In addition, it is to be understood that certain manufacturing requirements and custom pieces of the present invention may require more than one piece of fabric to construct the upper section 2 and/or lower section 1.

The present invention includes all sizes of mattresses including but not limited to cot, twin, full, queen, king, California king, and custom designed pieces.

The sand used in the present invention may be non-toxic, crushed white marble sand. This type of sand is preferable due to its advantageous properties. Crushed white marble sand has no silica, which some studies have shown to be a health hazard when breathed in as silica dust. In addition, it is preferable that the non-toxic, crushed white marble sand for use in the present invention contain no tremolite, which is an impurity that is considered unhealthy. Moreover, marble is said to have a sacred and serene energy that encourages restful sleep. Alternatively, the sand may be masonry sand, decomposed granite, or silica. The present invention, however, is not limited to sand as its earthen filler material. In some embodiments, the earthen filler material may include but is not limited to buckwheat hulls, wool wadding, latex foam, rice, pea gravel, pine straw, hay and salt.

The non-toxic, crushed white marble sand of the present invention preferably has a grain size between 5 to 10 mesh; or 10 to 20 mesh; or 20 to 40 mesh; or 40-80 mesh; or 80-120 mesh. The mattress of the present invention will not sag over time because the sand can be rolled out periodically to smooth and level the surface.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Reference will now be made in detail to the preferred embodiments of the invention.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A mattress for creating a natural sleep experience comprising:

a fabric shell including an upper section and a lower section, each section comprising a single piece of fabric and joined along the perimeter of each said section; and non-toxic, earthen filler material;

wherein the single piece of fabric of the lower section is larger than the single piece of fabric of the upper section and by virtue of the excess fabric and a vertical corner assembly, four vertical side walls of the mattress are created, the vertical corner assembly created from the single piece of fabric of the lower section of the mattress by gathering a corner of the fabric of the lower section, folding this corner inward to create a fabric triangle, valley folding this inner triangle to bisect its 90 degree apex, and stitching along both legs and hypotenuse of the resulting vertical fabric triangle with heavy duty, upholstery thread; and wherein a zippered aperture is located along a portion of the length of one of the four vertical side walls and through which the fabric shell of the mattress is accessible to fill with the non-toxic, earthen filler material.

2. The mattress of claim 1, wherein the upper section is a natural fiber fabric.

3. The mattress of claim 2, wherein the natural fiber fabric is selected from the group consisting of cotton canvas, hemp, denim, wool, and leather.

4. The mattress of claim 1, wherein the lower section is a synthetic fiber fabric.

5. The mattress of claim 4, wherein the synthetic fiber fabric is selected from the group consisting of Cordura® nylon, ballistic nylon, Kevlar® fabric, hemp, denim, heavy cotton canvas, and leather.

6. The mattress of claim 1, wherein the upper section and lower section are joined by a double reinforced stitched seam residing inside the interior of the fabric shell.

7. The mattress of claim 1, wherein the non-toxic, earthen filler material is selected from the group consisting of crushed white marble sand, masonry sand, decomposed granite, silica, buckwheat hulls, wool wadding, latex foam, rice, pea gravel, pine straw, hay and salt.

8. The mattress of claim 1, wherein the height of the four vertical side walls is between 2 and 6 inches.

9. The mattress of claim 1, wherein the zippered aperture is covered and hidden by a fabric flap affixed along its upper edge by stitching and removably affixed along its bottom, right, and left edges by hook and loop fasteners.

10. The mattress of claim 1, wherein the mattress is constructed in a variety of sizes including cot, twin, full, queen, king, California king, and custom designed pieces.

11. A method for constructing a mattress for creating a natural sleep experience including the steps of:

creating four vertical side walls by creating four vertical corner assemblies from a single piece of fabric of a lower section of the mattress by gathering a corner of the fabric of the lower section, folding this corner inward to create a fabric triangle, valley folding this inner triangle to bisect its 90 degree apex, and stitching along both legs and hypotenuse of the resulting vertical fabric triangle with heavy duty, upholstery thread;

joining an upper section of fabric to the lower section including the four vertical side walls by double stitched seams along the perimeter of the upper section and the perimeter of the lower section forming the open edge of the four vertical side walls;

creating a zippered aperture along a portion of the length of one of the four vertical side walls;

providing a cover for the zippered aperture by stitching a fabric flap along its upper edge above the zippered aperture and removably affixing by hook and loop fasteners along the bottom, right, and left edges of the fabric flap; and filling a fabric shell of the mattress created from the upper section and lower section with non-toxic, crushed white marble sand.

12. The method of claim 11, wherein the height of the four vertical corner assemblies and resulting four vertical side walls is 3 inches.

13. The method of claim 12, wherein the height is based on a volumetric calculation that allows for a particular shape of the mattress to be filled with an exact number of 50 pound bags of crushed white marble sand such that no partial 50 pound bags of sand are left over.

14. The method of claim 11, wherein the upper section is a natural fiber fabric.

15. The method of claim 14, wherein the natural fiber fabric is selected from the group consisting of cotton canvas, hemp, denim, wool, and leather.

16. The method of claim 11, wherein the lower section is a synthetic fiber fabric.

17. The method of claim 16, wherein the synthetic fiber fabric is selected from the group consisting of Cordura® nylon, ballistic nylon, Kevlar® fabric, hemp, denim, heavy cotton canvas, and leather.

18. The method of claim 11, wherein the upper section and lower section are joined by a double reinforced stitched seam residing inside the interior of the fabric shell.

19. The method of claim 11, wherein the heavy duty, upholstery thread is selected from the group consisting of between #42 to #92 2-ply or 3-ply bonded nylon, bonded polyester, cotton-wrapped polyester, and Kevlar®.

20. The method of claim 11, wherein the non-toxic, crushed marble white sand has a grain size between 20 to 40 mesh.

* * * * *